US007512993B1

(12) United States Patent
Gutierrez

(10) Patent No.: US 7,512,993 B1
(45) Date of Patent: Apr. 7, 2009

(54) CAR SEAT BABY BIB

(76) Inventor: Hector A. Gutierrez, 73 N. San Marino Ave., Pasadena, CA (US) 91107

( * ) Notice: Subject to any disclaimer, the term of this patent is extended or adjusted under 35 U.S.C. 154(b) by 0 days.

(21) Appl. No.: 12/072,347

(22) Filed: Feb. 26, 2008

(51) Int. Cl.
*A41B 13/10* (2006.01)

(52) U.S. Cl. ..... 2/49.1; 2/52

(58) Field of Classification Search ..... 2/48, 2/49.1–49.5, 46, 50, 51, 52, 104, 102, 207, 2/111, 75, 80; 297/482, 219.12, 256.15, 297/465, 487, 488, 182; 280/801.1; D2/860–864
See application file for complete search history.

(56) References Cited

U.S. PATENT DOCUMENTS 1,616,349 A * 2/1927 Cagle ..... 297/465
1,837,983 A 12/1931 Moran
2,430,941 A 11/1947 Long
2,518,357 A 8/1950 Miles
2,532,932 A 12/1950 Neiswander
2,571,888 A 10/1951 Jesse
2,637,852 A * 5/1953 Globe ..... 2/51
2,653,324 A 9/1953 McMahon
2,738,511 A 3/1956 Brady
2,948,037 A * 8/1960 Bugyi ..... 24/698.3
3,540,060 A 11/1970 Brown
3,979,776 A * 9/1976 Gruenwald ..... 2/49.1
4,330,152 A * 5/1982 Legan et al. ..... 297/465
4,620,323 A 11/1986 Tepper
D288,260 S 2/1987 Anderson et al.
4,639,946 A * 2/1987 Koenig ..... 297/465
4,678,205 A * 7/1987 Wold ..... 280/808
4,741,574 A * 5/1988 Weightman et al. ..... 297/482
D304,875 S 12/1989 Benson
4,953,816 A * 9/1990 Wilkinson ..... 248/102
4,973,106 A * 11/1990 Strovinskas ..... 297/482
D341,472 S 11/1993 Watson
5,429,418 A * 7/1995 Lipper et al. ..... 297/465
5,490,289 A 2/1996 Lehrer
5,580,133 A * 12/1996 Knox et al. ..... 297/464
5,666,665 A 9/1997 Morgado
5,765,225 A 6/1998 Goeckeritz et al.
D402,087 S 12/1998 Scherich
6,017,094 A * 1/2000 Syiek ..... 297/482
D420,204 S 2/2000 Sasani
6,036,260 A * 3/2000 Mullen ..... 297/184.13
D446,384 S 8/2001 Cruz
D448,143 S 9/2001 Shealey
6,322,149 B1 * 11/2001 Conforti et al. ..... 297/482
6,394,554 B1 * 5/2002 Hingle ..... 297/482
6,409,271 B1 * 6/2002 Caramanis ..... 297/482
6,442,759 B1 9/2002 Straham, Jr. et al.
6,481,016 B1 11/2002 Rees
D473,364 S 4/2003 Conte
D492,091 S 6/2004 Nakama-Mitsunaga
D493,024 S 7/2004 Bergkvist
6,783,185 B1 * 8/2004 Sutton et al. ..... 297/482
6,826,780 B1 * 12/2004 Romesburg ..... 2/49.2

(Continued)

*Primary Examiner*—Amy B Vanatta

(57) ABSTRACT

A car seat baby bib having a bib portion with a partial opening and fastening ends that are releasably secured to opposed ends of a seat belt harness of a car seat. Fastening straps are provided for attachment to the opposed ends of the seat belt harness allowing the fastening ends of the bib portion to attach thereto. The bib does not attach around the neck of the infant and can be easily attached or removed from the seat belt harness of the infant car seat.

14 Claims, 4 Drawing Sheets

U.S. PATENT DOCUMENTS 6,863,350 B1 * 3/2005 McCulley et al. ..... 297/465
7,069,596 B2 7/2006 Rees
D525,766 S 8/2006 Lown et al.
D526,765 S 8/2006 Lown et al.
D539,513 S 4/2007 Billings

* cited by examiner

CAR SEAT BABY BIB

FIELD OF THE INVENTION

The invention relates in general to baby bibs. More specifically, the invention relates to a baby bib adapted to be secured to baby seat. The baby bib has a partial opening that fits under the chin of the infant, and fastening ends that are releasably secured to opposed ends of seat belt harness of the car seat. Fastening straps are also provided for attachment to the opposed ends of the seat belt harness allowing the fastening ends of the bib portion to attach thereto.

BACKGROUND OF THE INVENTION

Baby bibs are typically secured around an infant's neck. When an infant is in a high chair it is generally easy to secure a baby bib around an infant's neck. However, securing a baby bib around the neck of an infant when the infant is fastened in a car seat is not easy due to the restrictive nature of the seat belt harness and large head rest of the car seat. Thus, there is a need to provide a baby bib for infant car seats that does not require the bib to be secured to neck of an infant fastened in the seat.

BRIEF SUMMARY OF THE INVENTION

The present invention provides its benefits across a broad spectrum of baby bibs for use on infants fastened by a harness in a chair or seat. Although the present invention is discussed in conjunction with infant car seats, it may be used in conjunction with infant strollers as well. While the description which follows hereinafter is meant to be representative of such applications, it is not exhaustive. As will be understood, the basic apparatus taught herein can be readily adapted to many uses. It is intended that this specification and the claims appended hereto be accorded a breadth in keeping with the scope and spirit of the invention being disclosed despite what might appear to be limiting language imposed by the requirements of referring to the specific examples disclosed.

It is one aspect of the present invention to provide a baby bib that can be easily secured and removed from an infant car seat.

It is another aspect of the present invention to provide a baby bib that is not

Is secured around the neck of an infant.

It is a feature of the present invention that the baby bib is releasably secured to an infant's car seat on opposed ends of a seat belt harness of the car seat adjacent the neck of an infant fastened in the car seat.

It is another feature of the present invention that fastening straps are adapted to attach to opposed ends of a seat belt harness of an infant car seat so that the baby bib can be easily secured and removed from the fastening straps.

It is still another feature of the present invention that the baby bib has a partial opening adapted to fit under the chin of an infant while having fastening ends adjacent the partial opening and on opposed sides of the partial opening separated by a distance greater than the opening width of the partial opening.

It is an advantage of the present invention that the baby bib is not secured to the neck of the infant, allowing a parent or care provider to quickly and easily attach or remove the baby bib when the infant is fastened in a car seat.

It is another advantage of the present invention that, with a plurality of bib portions having variety of different sized partial openings, the different sized bibs can be used as the infant grows.

These and other aspects, features, and advantages are achieved/attained in the apparatus of the present invention baby bib that comprises a bib portion having a partial opening adapted to fit under the chin of an infant. The bib portion has two fastening ends adjacent the partial opening on opposed side of the partial opening. The fastening ends are adapted to releasably secured to opposed ends of a seat belt harness of an infant's car seat. In one embodiment, fastening straps are provided to wrap around the opposed ends of the seat belt harness and attach thereto. In this embodiment the fastening ends of the bib portion are adapted to be releasably secured to the fastening straps on the seat belt harness.

In all embodiments the fastening ends of the bib portion are separated by a distance that is greater than the opening width of the partial opening of the bib portion. This configuration allows the bib to be releasably secured to the opposed ends of the seat belt harness of the infant's car seat without the need to secure the bib around the neck of the infant. Because the bib is not placed around the neck of the infant, nor secured around the infant's neck, the bib can be quickly and easily attached or removed. Access to the fastening ends is ample, since they are on opposed sides of the infant's neck just above the shoulders, and not behind the neck of the infant as with most prior art baby bibs.

As used herein, the term "infant" refers to any child or baby of age and size that is required to be secured in car seat when traveling in a vehicle. The term "car seat" or "infant car seat" refers to any safety seat for infants including infant only and convertible seats. The terms "releasably secured" and "releasably securing" refers to any manner known to those skilled in the art to quickly and easily attach and remove two items numerous times, such as with hook and loop fasteners, flexible magnets, or the like. The terms "releasably attach" and "releasably attached" refers to any manner known to those skilled in the art to attach two items together that are not intended to be removed frequently but can be removed and attached again, such as with hook and loop fasteners, zippers, buttons, laces, or the like. The terms "permanently attached" and "permanently attaching" refers to any manner known to those skilled in the art to secure two items permanently together, such as with adhesives, adhesive tape, stitching, or the like.

BRIEF DESCRIPTION OF THE DRAWINGS

The aspects, features and advantages of the present invention will become apparent upon consideration of the following detailed disclosure of the invention, especially when it is taken in conjunction with the accompanying drawings wherein.

To facilitate understanding, identical reference numerals have been used, where possible, to designate identical elements or features common to the figures.

DETAILED DESCRIPTION OF THE PREFERRED EMBODIMENTS

Figure 1:
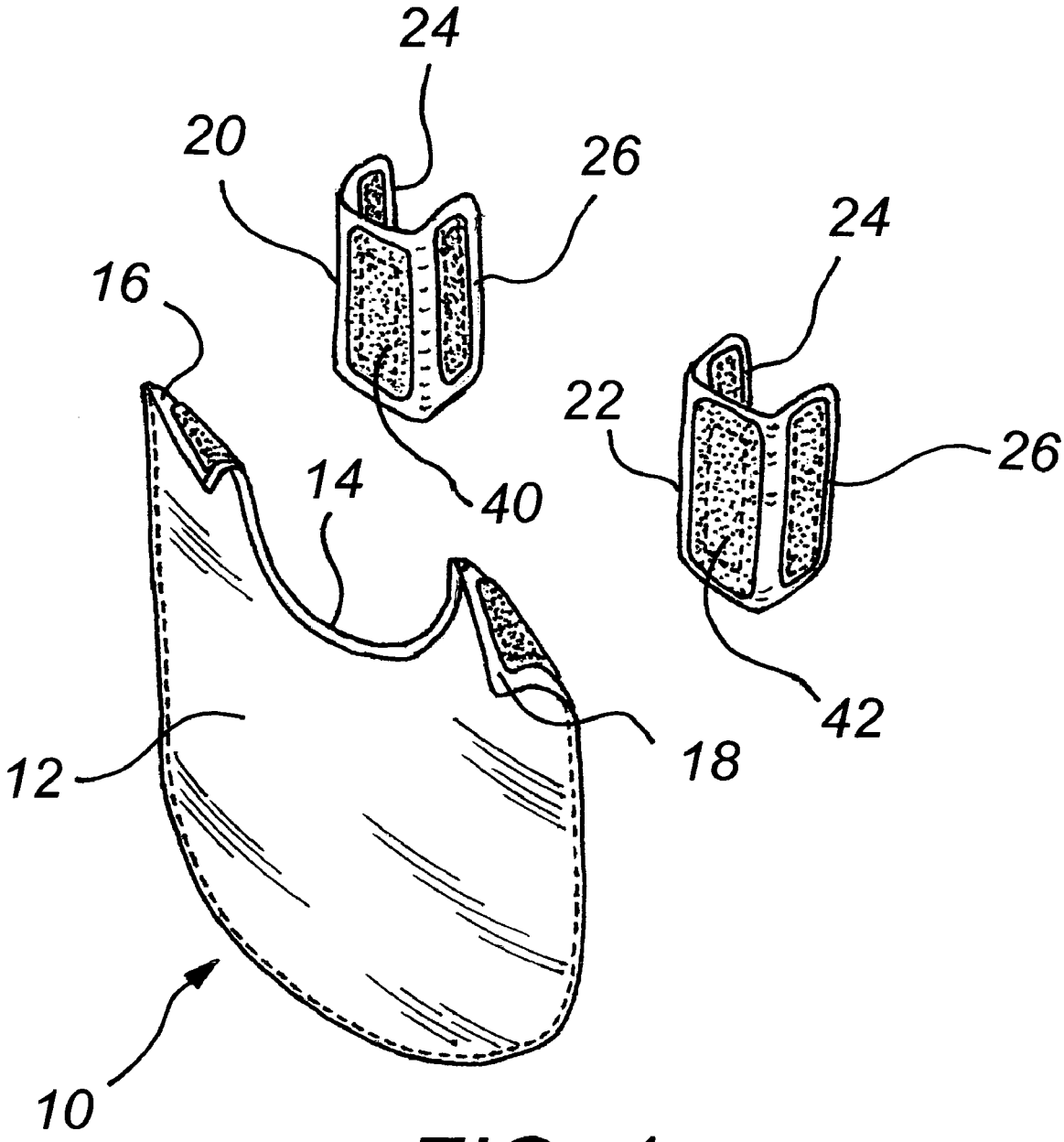
FIG. 1 is a perspective view of an embodiment of the present invention baby bib including fastening straps.

Referring to FIG. 1, a baby bib is shown generally by number 10 in accordance with a first embodiment of the present invention. The baby bib 10 comprises a bib portion 12 having a partial opening 14 adapted to fit under the chin of the infant. The bib portion 12 has two fastening ends, 16 and 18, that are adjacent the partial opening 14 and on opposed sides of the partial opening 14. The fastening ends, 16 and 18, are adapted to be releasably secured to the opposed ends of a seat belt harness of an infant's car seat.

In the embodiment shown in FIG. 1, the baby bib further comprises two fastening straps, 20 and 22, adapted to attach to the opposed ends of the seat belt harness. The fastening ends, 16 and 18, are releasably secured to fastening straps, 20 and 22, when the fastening straps are attached to the opposed ends of the seat belt harness. The fastening straps, 20 and 22, are provided with attachment ends, 24 and 26, that are adapted to wrap around opposed ends of a seat belt harness and releasably attach thereto. The attachment ends, 24 and 26, comprise hook and loop fasteners to allow each fastening strap, 20 and 22, to wrap around an opposed end of a seat belt harness and releasably attach thereto. Hook and loop fasteners, such as those manufactured by Velcro Industries B.V. Ltd. and sold under brand name VELCRO® may be used. Alternatively, as those skilled in the art realize, zippers, buttons, or laces may be used to releasably attach the fastening straps, 20 and 22, to the opposed ends of a seat belt harness.

Figure 3:
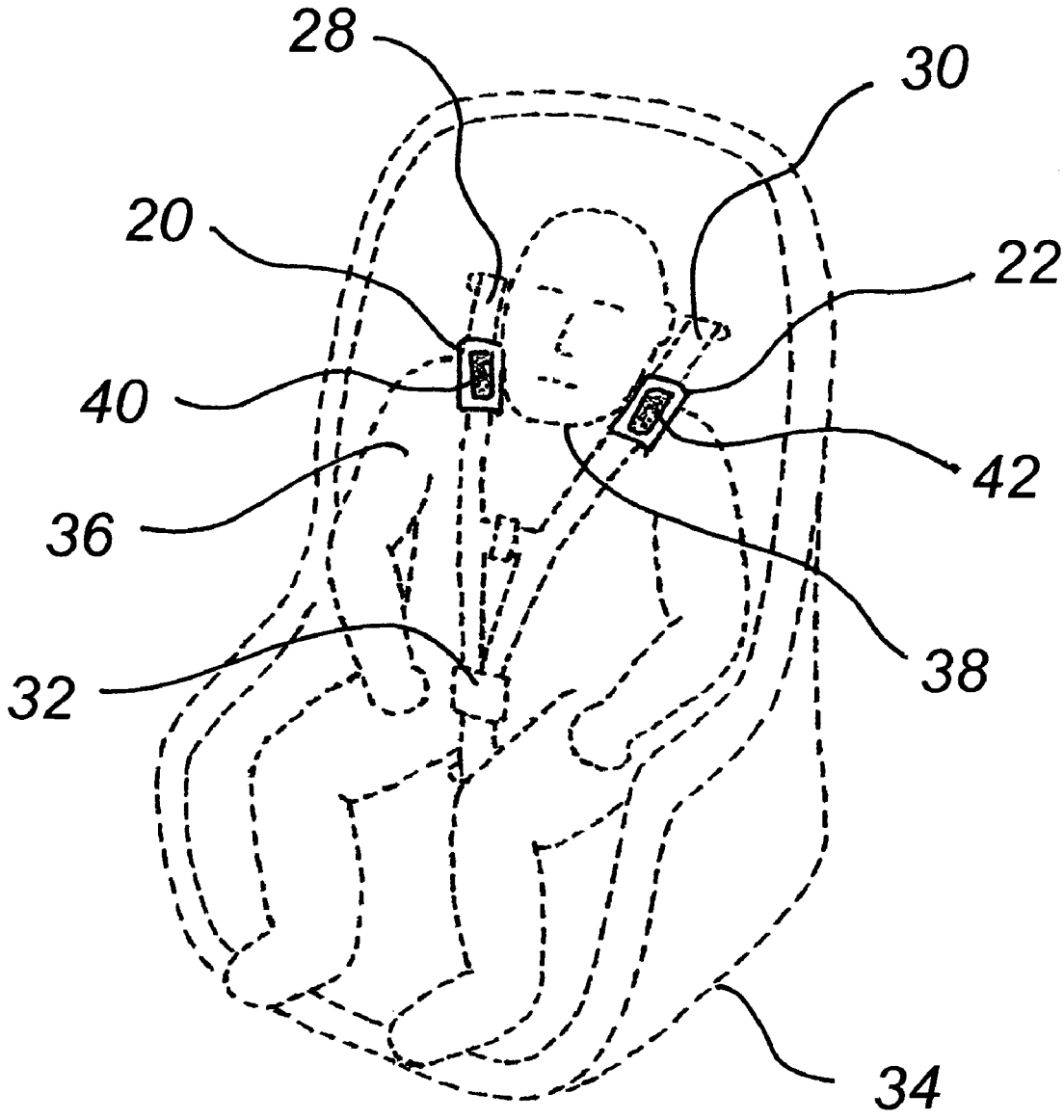
FIG. 3 is a perspective view of a infant fastened in a infant car seat including fastening straps releasably secured to the opposed ends of the seat belt harness of the car seat.
Figure 4:
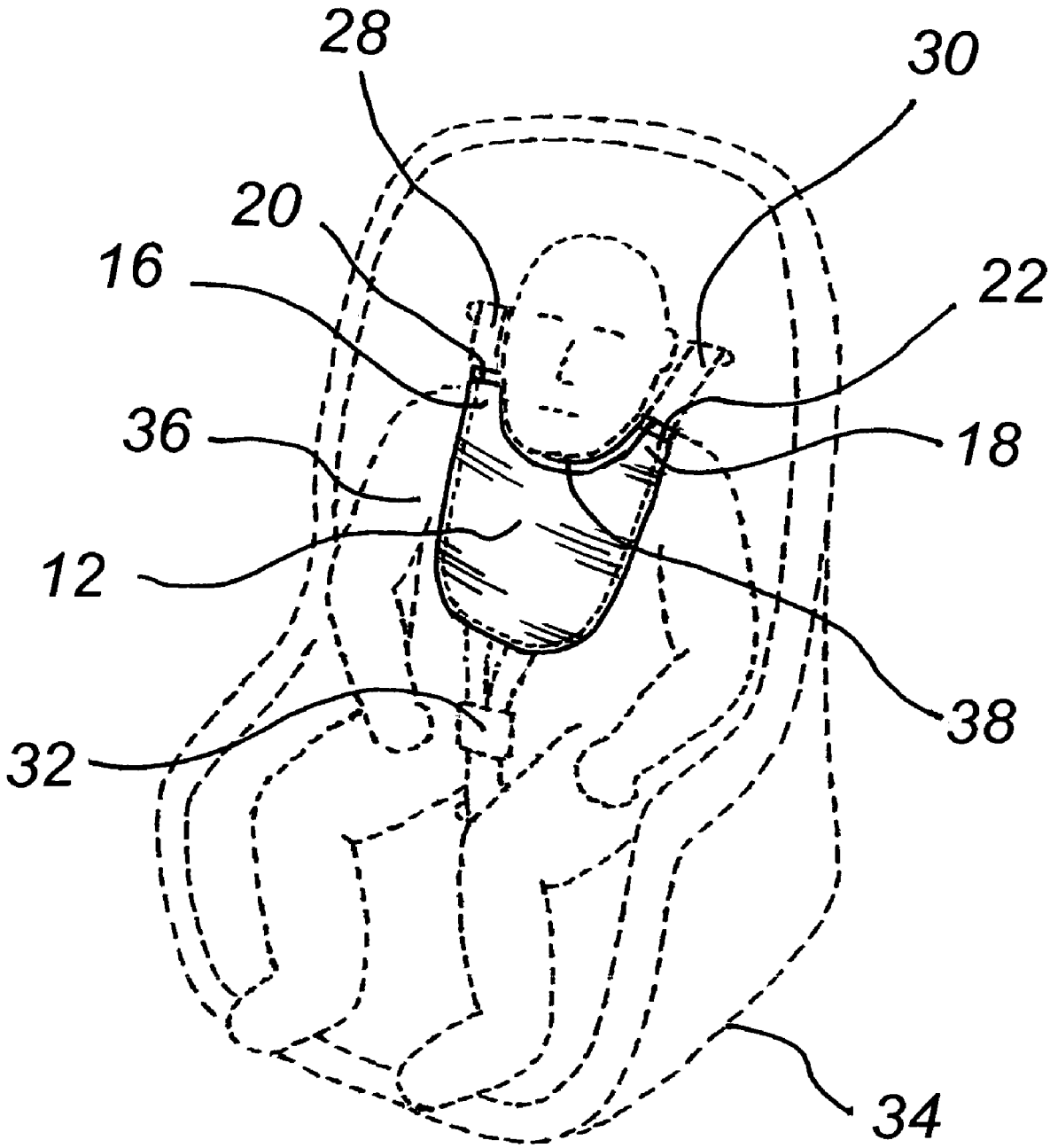
FIG. 4 is perspective view of the infant fastened in the car seat shown in FIG. 3 including the bib portion releasably secured to the fastening straps.

Referring to FIG. 3, the fastening straps, 20 and 22, are shown attached to opposed ends 28 and 30, of a seat belt harness 32 of an infant's car seat 34. Because the attachment ends 24 and 26 wrap around the opposed ends, 28 and 30, of the seat belt harness 32, their position is adjustable along the harness to accommodate different size infants. In FIG. 3 an infant 36 is shown already fastened in the car seat 34, and ready to accept the attachment of the bib portion 12. The bib portion 12 is simply positioned with the partial opening 14 under the chin 38 of the infant 36, and the fastening ends 16 and 18 are releasably secured to the fastening straps 20 and 22, as shown in FIG. 4. Preferably the fastening ends, 18 and 20, and the mounting faces, 40 and 42, of the fastening straps, 20 and 22, comprise hook and loop fasteners to provide the releasable attachment of the bib portion 12. The releasable attachment of the fastening straps, 20 and 22, to the mounting faces, 40 and 42, may also be achieved by the use of flexible magnets, if desired.

Figure 2:
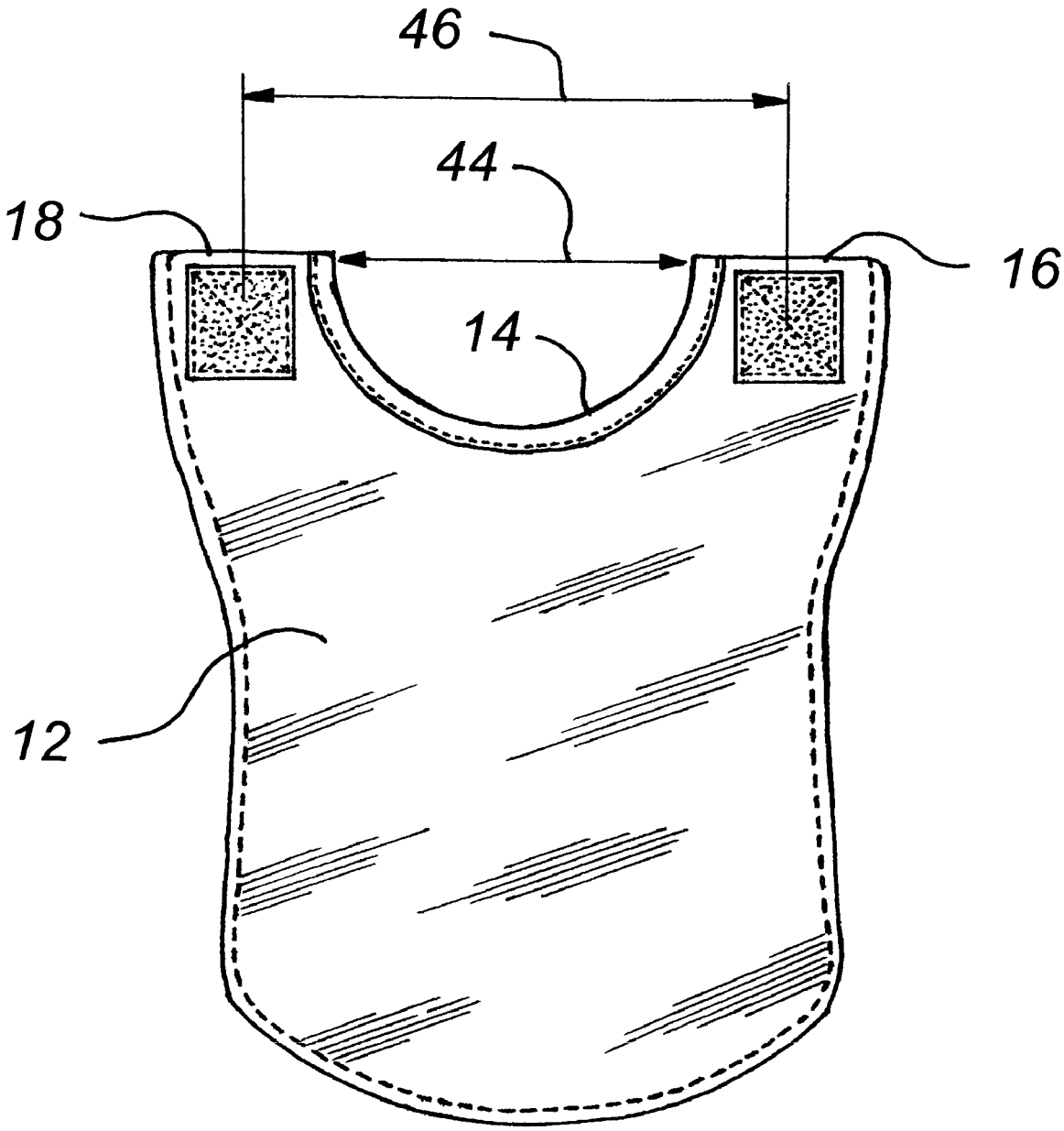
FIG. 2 is a back view of the bib portion of the present invention baby bib shown in FIG. 1.

Referring to FIG. 2, the partial opening 14 has an opening width 44 that is greater than the width of the neck of the infant, and the fastening ends, 18 and 20, are separated by a distance 46 that is greater than the opening width 44 of the partial opening 14. Significantly, this allows the bib to be releasably secured to the opposed ends of a seat belt harness of an infant's car seat without the need to secure the bib around the neck of the infant. Further, because the bib is not placed around the neck of the infant, nor secured around the infant's neck, the bib can be quickly and easily attached or removed. Access to the fastening ends, 18 and 20, is ample, since they are on opposed sides of the infant's neck just above the shoulders, and not behind the infant's neck.

In an alternative embodiment, the fastening straps 20 and 22 can be hook or loop fastener pieces that are permanently attached to the opposed ends 28 and 30 of the seat belt harness 32. This may be accomplished with the use of an appropriate adhesive such as contact cement, adhesive tape, or the like. However, it is preferred to have the fastening straps, 16 and 18, wrap around the opposed ends, 28 and 30, of the seat belt harness 32 because it allows for the adjustment of their position on the harness. Allowing for this adjustment is desirable, for example, as the infant grows the position of the bib 10 will need to be adjusted to provide optimal fit of the partial opening 14 under the chin 38 of the infant.

When hook and loop fasteners are used, it is preferable to have the hook portion on the fastening ends, 16 and 18, and the loop portion on the mounting face, 40 and 42, of the attachment ends, 24 and 26. Thus, when the bib portion 12 is not attached, only the loop portion is in proximity to the infant's neck. As those skilled in the art realize, the hook portion of a hook and loop fastener, as opposed to the loop portion, can produce irritation when in contact with an infant's skin. This is avoided by having the loop portion on the mounting faces, 40 and 42, of the fastening straps, 20 and 22.

As is well known to those skilled in the art, any suitable material may be used to fabricate the bib portion 12 and fastening straps, 20 and 22. For example, a combination of a cotton fabric and padding can be sewn together to form the fastening straps, 20 and 22, and layers of a felt and moisture blocking material to form the bib portion 12. Preferably, when hook and loop fasteners are used, they are appropriately sewn into to the bib portion 12 and fastening straps, 20 and 22, so that they will not detach during extensive use and washing.

As an infant grows, a number of different sizes baby bibs are needed. Thus, the baby bib of the present invention may be provided as a baby bib kit, with a variety of different sized bib portions 12 provided to accommodate the growth of the child. Alternatively, individual bib portions 12 can be sold separately, and additional sets of fastening straps, 20 and 22, can be sold when multiple infant car seats are involved. However, for each bib portion 12, the distance 46 between the fastening ends, 18 and 20, is always greater than the opening width 44 of the partial opening 14. This maintains the ease of attachment of each bib portion 12 with the fastening straps, 20 and 22.

What has been described are preferred embodiments of a baby bib adapted to be releasably secured to a infant's car seat on opposed ends of a seat belt harness of the car seat. Although a number of embodiments have been described above in detail, those skilled in the art will appreciate that numerous modifications are possible without materially departing from the novel teachings and advantages of the subject matter described herein. Other modifications, substitutions, changes, and omissions may be made in the design and arrangement of the preferred and other exemplary embodiments without departing from the spirit of the present invention.

What is claimed is:

1. A baby bib adapted to be releasably secured to an infant's car seat on opposed ends of a seat belt harness of the car seat adjacent the neck of an infant fastened in the car seat, the baby bib comprising:

a bib portion having a partial opening adapted to fit under the chin of the infant, the partial opening having an opening width greater than the width of the neck of the infant, the bib portion having two fastening ends, the fastening ends adjacent the partial opening and on opposed sides of the partial opening, the fastening ends separated by a distance greater than the opening width of the partial opening, the two fastening ends adapted to be releasably secured to the opposed ends of the seat belt harness separated by the distance greater than the opening width of the partial opening and adjacent the neck of the infant;

two fastening straps adapted to releasably attach to the opposed ends of the seat belt harness adjacent the neck of the infant, the fastening ends of the bib portion adapted to be releasably secured to the fastening straps when the fastening straps are attached to the opposed ends of the seat belt harness adjacent the neck of the infant;

wherein the fastening straps further comprise attachment ends adapted to wrap around the opposed ends of the seat belt harness and releasably attach thereto when the fastening straps are attached to the opposed ends of the seat belt harness adjacent the neck of the infant.

2. The baby bib of claim 1 wherein the fastening straps and the fastening ends comprise hook and loop fasteners for releasably securing the fastening ends to the fastening straps.

3. The baby bib of claim 1 wherein the fastening straps are permanently attached to the opposed ends of the seat belt harness adjacent the neck of the infant.

4. The baby bib of claim 1 wherein the fastening straps are releasably attached to the opposed ends of the seat belt harness adjacent the neck of the infant.

5. The baby bib of claim 1 wherein the attachment ends of the fastening straps comprise hook and loop fasteners that attach thereto when the fastening straps are releasably attached to the opposed ends of the seat belt harness adjacent the neck of the infant.

6. A baby bib adapted to be releasably secured to an infant's car seat on opposed ends of a seat belt harness of the car seat adjacent the neck of an infant fastened in the car seat, the baby bib comprising:

a bib portion having a partial opening adapted to fit under the chin of the infant, the partial opening having an opening width greater than the width of the neck of the infant, the bib portion having two fastening ends, the fastening ends adjacent the partial opening and on opposed sides of the partial opening, the fastening ends separated by a distance greater than the opening width of the partial opening; and, two fastening straps comprising attachment ends adapted to wrap around the opposed ends of the seat belt harness and releasably attach thereto when the fastening straps are attached to the opposed ends of the seat belt harness adjacent the neck of the infant, the fastening ends of the bib portion adapted to be releasably secured to the fastening straps and separated by the distance greater than the opening width of the partial opening when the fastening straps are attached to the opposed ends of the seat belt harness adjacent the neck of the infant.

7. The baby bib of claim 6 wherein the fastening straps and the fastening ends comprise hook and loop fasteners for releasably securing the fastening ends to the fastening straps.

8. The baby bib of claim 7 wherein the fastening straps are permanently attached to the opposed ends of the seat belt harness adjacent the neck of the infant.

9. The baby bib of claim 6 wherein the attachment ends of the fastening straps comprise hook and loop fasteners that attach thereto when the fastening straps are releasably attached to the opposed ends of the seat belt harness adjacent the neck of the infant.

10. A infant car seat baby bib accessory kit comprising a plurality of bib portions wherein each bib portion is adapted to be releasably secured to an infant's car seat on opposed ends of a seat belt harness of the car seat adjacent the neck of an infant fastened in the car seat wherein:

each said bib portion having a partial opening adapted to fit under the chin of the infant, the partial opening having an opening width greater than the width of the neck of the infant, each said bib portion having two fastening ends, the fastening ends adjacent the partial opening and on opposed sides of the partial opening, the fastening ends separated by a distance greater than the opening width of the partial opening, each said bib portion partial opening having a different said opening width than other said bib portions to accommodate different neck widths of infants, the baby bib accessory kit further comprising;

at least two fastening straps comprising attachment ends adapted to wrap around the opposed ends of the seat belt harness and releasably attach thereto when the fastening straps are attached to the opposed ends of the seat belt harness adjacent the neck of the infant, the fastening ends of each said bib portion adapted to be releasably secured to the fastening straps and separated by the distance greater than the opening width of the partial opening of each said bib portion when the fastening straps are attached to the opposed ends of the seat belt harness adjacent the neck of the infant.

11. The baby bib accessory kit of claim 10 wherein the fastening straps and the fastening ends of each said bib portion comprise hook and loop fasteners for releasably securing the fastening ends to the fastening straps.

12. The baby bib accessory kit of claim 11 wherein the fastening straps are permanently attached to the opposed ends of the seat belt harness adjacent the neck of the infant.

13. The baby bib accessory kit of claim 11 wherein the fastening straps are releasably attached to the opposed ends of the seat belt harness adjacent the neck of the infant.

14. The baby bib accessory kit of claim 10 wherein the attachment ends of the fastening straps comprise hook and loop fasteners that attach thereto when the fastening straps are releasably attached to the opposed ends of the seat belt harness adjacent the neck of the infant.

* * * * *